US006659143B1

(12) United States Patent
Taylor et al.

(10) Patent No.: US 6,659,143 B1
(45) Date of Patent: Dec. 9, 2003

(54) VAPOR RECOVERY APPARATUS AND METHOD FOR GASOLINE DISPENSING SYSTEMS

(75) Inventors: Ken W. Taylor, Oakridge, NC (US); Robert G. McKinney, Houston, TX (US)

(73) Assignee: Dresser, Inc., Addison, TX (US)

( * ) Notice: Subject to any disclaimer, the term of this patent is extended or adjusted under 35 U.S.C. 154(b) by 0 days.

(21) Appl. No.: 10/161,162

(22) Filed: May 31, 2002

(51) Int. Cl.[7] ..... B65B 1/04
(52) U.S. Cl. ..... 141/59; 141/45
(58) Field of Search ..... 141/44–46, 59

(56) References Cited

U.S. PATENT DOCUMENTS 4,290,781 A 9/1981 Wang ..... 55/17
5,217,051 A 6/1993 Simpson et al. ..... 141/59
5,850,857 A 12/1998 Simpson ..... 141/59
5,904,189 A * 5/1999 Berger et al. ..... 141/59
5,904,472 A * 5/1999 Olson et al. ..... 417/405

* cited by examiner

*Primary Examiner*—Steven O. Douglas
(74) *Attorney, Agent, or Firm*—Fish & Richardson P.C.

(57) ABSTRACT

An apparatus and method for recovering vapor during the dispensing of gasoline via a hose into a vehicle tank, according to which a turbine disposed in a vapor passage and is activated in response to the dispensing of the gasoline for drawing the vapor from the tank and into the vapor passage. Blades on the turbine separate the air from the gasoline vapor. The vapor is returned to the liquid stream and the air discharged to atmosphere. The apparatus therefore does not require vapor return piping to the underground tanks.

20 Claims, 3 Drawing Sheets

10
12
16
18
20
22
24
24
26
28
30
30a
32
32a
34
34a
36a
40
40a
14

VAPOR RECOVERY APPARATUS AND METHOD FOR GASOLINE DISPENSING SYSTEMS

BACKGROUND

This invention relates to a vapor recovery apparatus and method and, more particularly to such an apparatus and method for recovering gasoline vapors from a gasoline dispensing systems.

In a gasoline service station for dispensing gasoline to vehicles, several gasoline dispensing units, or pumps, are provided which receive gasoline stored in one or more underground storage tanks and dispense the gasoline, via dispensing nozzles, to the vehicles.

In these arrangements, gasoline vapor is present in the fuel tank of the vehicle and released from the gasoline flow which can discharge to atmosphere if not properly recovered. In compliance with government regulations that require this gasoline vapor to be recovered, various types of systems have evolved.

By far the most common recovery systems of this type utilize a dual hose arrangement with one hose supplying the gasoline from the underground storage tank to the dispensing nozzle for dispensing into the vehicle, and the other hose passing the gasoline vapors from the vehicle tank to the underground storage tank. With all currently known vapor recovery systems of this type, extensive vapor return piping, along with associated pumps and valves, are required to conduct the collected vapor from the vehicle tank, through the dispensing unit and back to the underground storage tank. Of course, in relatively old installations, if this piping has not been provided during the initial construction, the station forecourt has to be dug up to install the underground portion of the system, which considerably adds to the cost of the installations.

Therefore what is needed is a vapor recovery system that eliminates the need to transfer the recovered vapors to the underground gasoline storage tank, and therefore eliminates the cost and complexity of such systems.

SUMMARY

The present invention is directed to an apparatus and method for recovering vapor during the dispensing of fuel via a hose into a vehicle tank. An embodiment of the invention has a compressor disposed in a vapor passage. The compressor is activated in response to the dispensing of the fuel for drawing the vapor from the tank and into the vapor passage. Blades on the compressor separate the air from the gasoline vapor. The recovered vapor is reintroduced into the fuel flow and the air is released to the atmosphere.

An advantage of the invention is that it operates by motion of the fluid flow to the vehicle tank, and therefore saves on electrical power cost because no electrical power is needed.

An advantage of the invention is that recovered vapor can be reintroduced back into the fuel stream at the fuel hose, thereby eliminating a lengthy fluid path back to the source fuel tank. This reduces the susceptibility of the system to leaks, for example in the dispenser itself, in the underground pipes, or at the fuel tank or tank vent. Also, because the recovered vapor is not routed to the fuel tank, it does not pressurize the fuel tank.

These and other advantages of the invention will be come apparent from the following Drawings and Description of the Preferred Embodiment.

DESCRIPTION OF A PREFERRED EMBODIMENT

Figure 1:
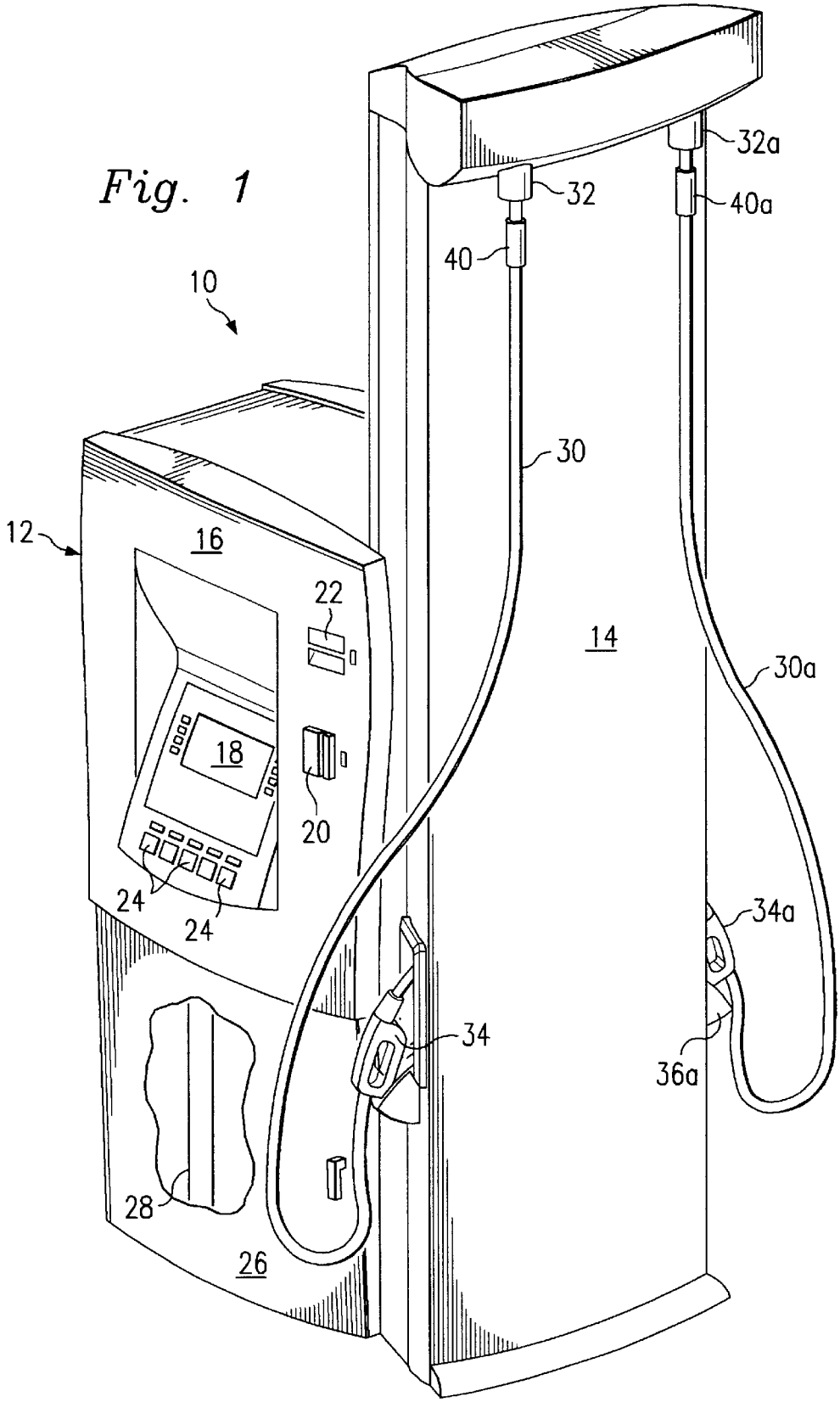
FIG. 1 is an isometric view of a gasoline dispensing unit employing vapor recovery apparatus according to an embodiment of the present invention.
Figure 2:
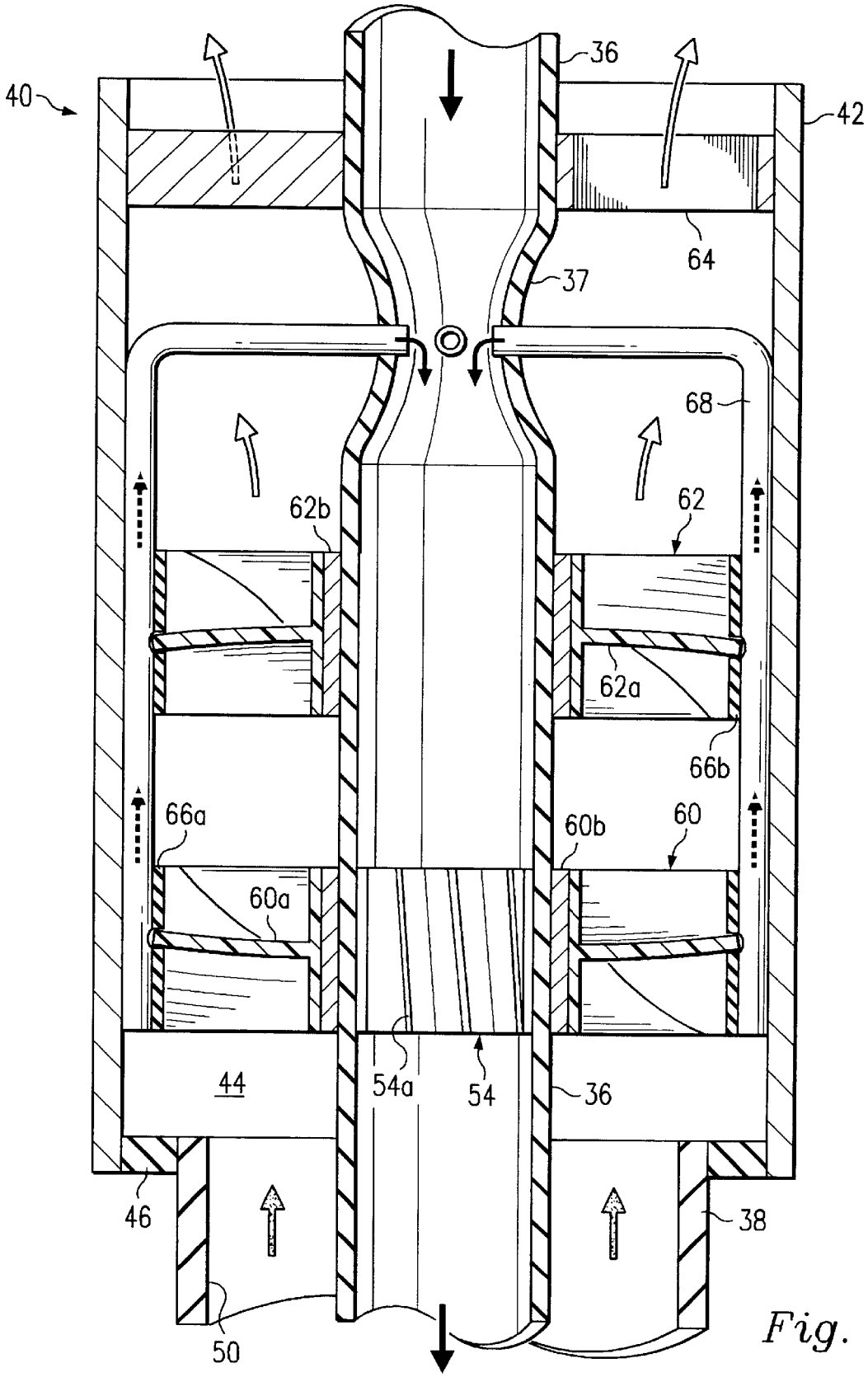
FIG. 2 is an enlarged, cross-sectional view of the vapor recovery apparatus of the embodiment of FIG. 1.

With reference to FIGS. 1 and 2 of the drawings, the reference numeral 10 refers, in general, to a gasoline dispensing unit consisting, in general, of a dispenser housing 12, and a hose tower 14 extending to one side of the housing.

The housing 12 includes a front bezel, or panel, 16, a side portion of which overlaps a portion of the hose tower 14. The center portion of the panel 16 is slightly recessed and includes a display 18 for displaying information relating to the gasoline dispensing operation. A credit card reader 20 and a receipt dispenser 22 are provided to the side of the display 18, and a series of octane select buttons 24 are mounted below the display 18.

A door 26 extends over a compartment in the lower portion of the housing 12 below the panel 16 which receives hydraulics including a conduit 28 that extends to an underground storage tank for the gasoline to be dispensed. Although not shown in the drawings, it is understood that the conduit 28 also extends to the hose tower 14 for passing gasoline to one end of a hose assembly 30 which extends from a fitting 32 at the upper portion of is the tower. A nozzle 34 is connected to the other end of the hose assembly 32 for dispensing the gasoline to a vehicle.

A hose assembly 30*a* extends from a fitting 32*a* extending from the upper portion of the tower 14, and receives a nozzle 34*a* The hose assembly 30*a* and the nozzle 34*a* are similar to the hose assembly 30 and the nozzle 34. Although not shown in the drawing, it is understood that the dispenser housing 12 has a rear panel that receives similar components as the panel 16 which are associated with the hose assembly 30*a* and which function in a similar manner to the latter components.

A pump (not shown) is provided for pumping the gasoline from the storage tank to the conduit 28 when the unit 10 is activated, so that the gasoline flows through the conduit 28 and the hose assembly 30 to the nozzle 34 which can be manually activated for dispensing the fuel into the gasoline tank of a vehicle. The nozzle 34 also has an inlet for receiving a mixture of gasoline vapor and air from the latter tank during the dispensing of the gasoline, which mixture is processed in a manner to be described.

As shown in FIG. 2, the hose assembly 32 includes an inner hose 36 and an outer hose 38 extending over, or around, a portion of the inner hose. The inner hose 36 receives gasoline from the conduit 28 (FIG. 1) and passes it to the nozzle 34 in a direction shown by the solid-line arrow in FIG. 2. A portion of the inner hose 36 has a reduced-diameter portion to form a venturi section 37 for forming a reduced pressure zone for reasons to be described.

A separator unit 40 extends over a portion of the inner hose 36 near the fitting 32, and includes an casing 42 which is greater than the outer diameter of the inner hose 32*a* to form an annular chamber 44. The casing 42 is preferably circular in cross section and includes a first truncated, frusto-conical portion 42*a* that is tapered inwardly in a direction away from the hose tower 14 (FIG. 1); and a second truncated frusto-conical portion 42*b* that extends from the portion 42*a*, and is tapered outwardly in the same direction.

The upper end of the casing portion 42*a* is open, and an annular coupling plate 46 is attached to the lower end of the casing portion 42*b*. The inner hose 36 extends through the casing 42, and the corresponding end of the outer hose 38 is coupled to the plate 46 and extends over the inner hose 36 from the plate to the nozzle 34. The inner diameter of the outer hose 38 is greater than the outer diameter of the inner hose 36 to form an annular, vapor recovery, passage 50 which receives gasoline vapor from the vehicle tank, via the nozzle, during the dispensing of the gasoline.

A turbine 54 is mounted for rotation in the inner hose 36, and has a plurality of blades 54*a* extending from a central shaft. The blades 54*a* are in the path of the gasoline flowing through the inner hose 36 so that the fluid causes rotation of the turbine.

A compressor 60 is rotatably mounted in the chamber 44 and extends around the downstream end portion of the turbine 54. The compressor 60 includes a plurality of concave, porous, and hydrodynamically smooth blades 60*a* extending from a hollow shaft 60*b* that surrounds the inner hose 36. The blades 60*a* are arranged in an opposite direction to the blades 56 of the turbine 54 and are hollow to form a passage for receiving vapor that passes through the porous walls of the blades as will be described. The compressor 60 is magnetically coupled to the turbine 54 so that the above rotation of the turbine 54 causes corresponding rotation of the compressor 60.

A rotor 62 is also rotatably mounted in the chamber 44 and extends around the upstream end portion of the turbine 54 in a spaced relation to the compressor 60. The rotor 62 includes a plurality of concave, porous, and hydrodynamically smooth blades 62*a* extending from a hollow shaft 62*b* that surrounds the inner hose 36. The blades 62*a* are also arranged in an opposite direction to the blades 54*a* of the turbine 54 and are also hollow to form a passage for receiving vapor that passes through the porous walls of the blades as will be described. The rotor 62 is free-spinning, and a stator 64 is mounted to the exterior surface of the casing 42 in radial alignment with the rotor 62. The stator 64 interacts aerodynamically with the rotor in a manner to be described.

The turbine 54 is mounted in the inner hose 26, and the compressor 60 and the rotor 62 are mounted in the chamber 44, in a manner to enable them to rotate about their respective longitudinal axes while being restrained against axial movement. This mounting of the turbine 54, the compressor 60 and the rotor 62; as well as the magnetic coupling between the turbine and the compressor and rotor are done in a conventional manner such as disclosed in U.S. Pat. No. 5,217,051 the disclosure of which is incorporated by reference.

Two axially-spaced, annular ring seals 66*a* and 66*b* are provided at the radial outer edges of the compressor blades 60*a* and the rotor blades 62*a*, respectively, and are attached to the blades in any know manner. An annular collector 68 has a portion extending along the inner wall of the casing portion 42*b* in alignment with the ring seals 66*a* and 66*b*.

Figure 3:
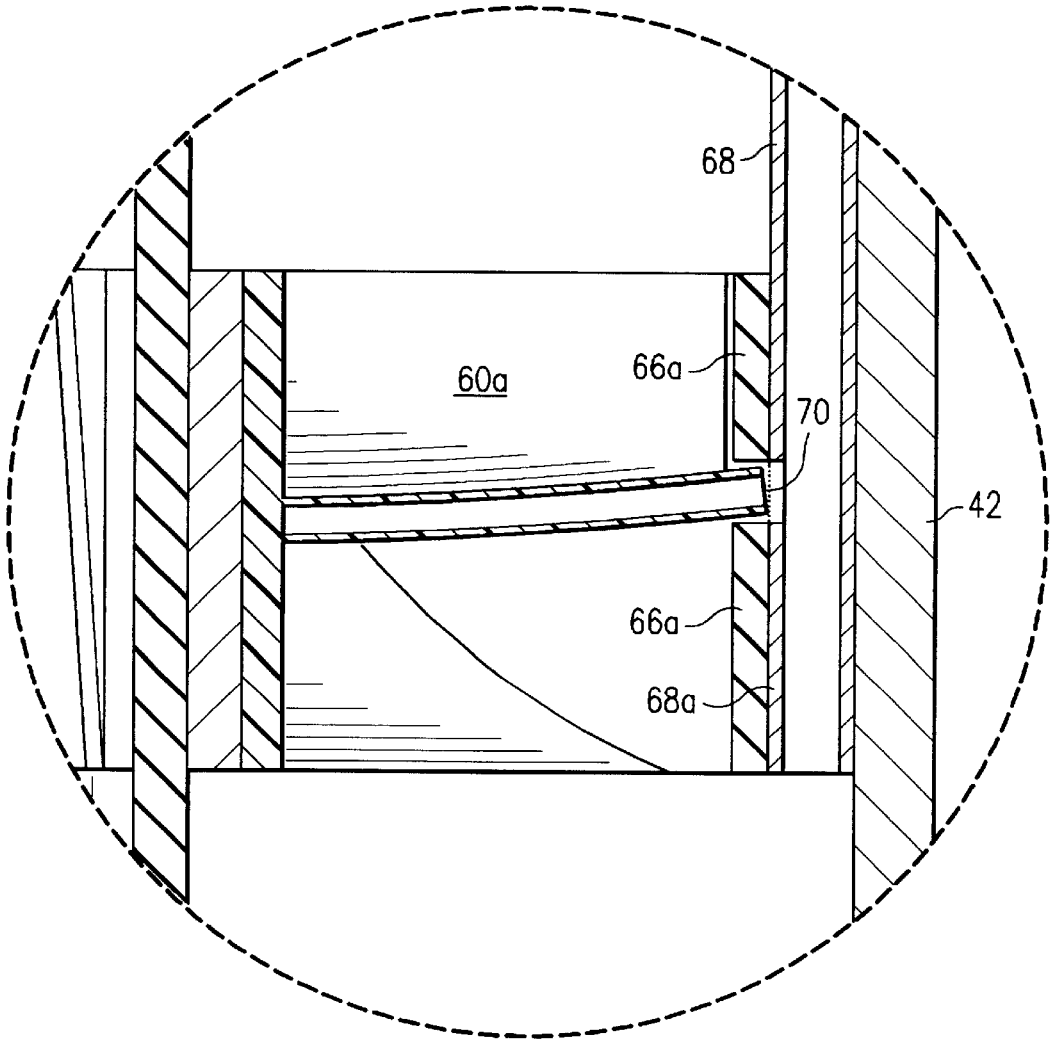
FIG. 3 is an enlarged portion of the component of FIG. 2.

As better shown in FIGS. 3 and 4 in connection with one of the blades 60*a* of the compressor 60, a nipple 70 is formed on the outer edge of each blade 60*a* and extends though a slot formed in the seal ring 66*a* and to a port 68*a* formed in the collector 68. The end of the nipple 70 is porous so that vapor collected in the interior of each blade 60*a* passes through the corresponding nipple, and into the collector 68. Although not shown in FIG. 3, it is understood that nipples, similar to the nipple 70, are provided on the remaining blades 60*a* of the compressor 60 and on all of the blades 62*a* of the rotor; and that corresponding slots are provided in the seal rings 66*a* and 66*b*, and corresponding ports are provided in the collector 68.

The remaining portion of the collector 68 extends axially upstream from the portion of the collector discussed above, and then radial inwardly to the venturi section 37 of the inner hose 36. The aforementioned rotatable seal formed by the ring seals 66*a* and 66*b* and the collector 68 confines the axial movement of vapor through the collector.

In operation, gasoline is pumped from the storage tank, through the conduit 28 (FIG. 1) to the hose tower 14, and through the inner hose 36 to the vehicle to be serviced, in the direction indicated by the solid arrow in FIG. 2. The turbine 54 thus rotates in proportion to the flow of gasoline through the hose 36 by virtue of the forces applied by the gasoline to the blades 54*a*. Due to the magnetic coupling between the turbine 54 and the compressor 60, the compressor rotates in the chamber 44 in a direction opposite the direction of rotation of the turbine.

The rotation of the compressor 60 creates forces that draw a mixture of air and gasoline vapors from the vehicle tank through the nozzle 34, into and through the passage 50, and into the chamber 44 as indicated by the dotted-dashed arrows in FIG. 2.

The air/vapor mixture in the chamber 44 is compressed by the compressor 60 and a portion of the relative light air of the mixture is separated from a portion of the relatively heavy vapor due to the vapor layering, by molecular weight, on the smooth, porous surfaces of the compressor blades 60*a*. The separated vapor, which consists largely of hydrocarbons, passes through the pores of the blades 60*a* into the interior of the blades, and through the nipples 70 of each blade, before passing through the ports 68*a* of the collector 68 and into the interior of the collector, with this movement being assisted by the centrifugal force of the motion of the blades 60*a*.

The remaining portion of the mixture and the separated air from the above first-stage separation passes to the rotor 62, with the force of the mixture and the air on the blades 62*a* of the rotor causing it to rotate in a direction opposite the direction of rotation of the compressor. A second-stage separation of the relative light air from the relatively heavy vapor of a portion of the mixture occurs by the vapor components of the mixture layering, by molecular weight, on the smooth, porous surfaces of the rotor blades 62*a*. The separated vapor, which consists largely of hydrocarbons, passes through the pores of the blades 62*a*, into the interior of the blades, and through the nipples of each blade, before passing through the ports of the collector 68 and into the interior of the collector, with this movement being assisted by the centrifugal force of the motion of the blades 62*a*. During this separation, the stator 64 interacts aerodynamically with the rotor 62 in a manner to reduce turbulence and promote laminar flow of the air/vapor mixture along the surface of the blades 62*a* to promote the separation.

The low pressure caused by the venturi section 37 of the inner hose 36 provides a suction train that promotes permeation of vapor through the porous blades 60*a* and 62*a*, through the ports 68*a* of the collector 68, and through the collector, as described above. The venturi section 37 of the inner hose 36 is also porous so that the vapor passes from the collector 68 into the interior of the hose. In the hose 36 the collected vapor mixes with the gasoline flowing through the hose and is thus reintroduced into the vehicle. The separated air is discharged through the open end of the casing portion 42*a* as shown by the dotted arrows.

Therefore, the above embodiment eliminates the need for costly and complex vapor recovery systems that require transferring the recovered vapor from the vehicle tank to the gasoline storage tank.

It is understood that variations may be made in the foregoing without departing from the scope of the invention. For example, it is understood that one or more additional rotor/stator sets can be used as needed to accomplish substantially complete separation of the gasoline vapors from the air. Also, the terms "hose", "conduit", "passage" etc. are not limited to any particular fluid flow device but are equally applicable to all such devices. Also, spatial references, such as "upper", "lower", etc. are for the purpose of illustration only and do not limit the specific orientation or location of the structure described above Since other modifications, changes, and substitutions are intended in the foregoing disclosure, it is appropriate that the appended claims be construed broadly and in a manner consistent with the scope of the invention.

What is claimed is:

1. A vapor recovery method comprising flowing gasoline through a hose and into a vehicle tank, establishing a passage connected to the vehicle tank, activating a compressor in the passage in response to the dispensing of the gasoline so that the compressor draws a mixture of gasoline vapor and air from the tank and into the passage, separating the air from the vapor in the vapor passage, and recycling the separated vapor back into the gasoline flowing through the hose.

2. The method of claim 1 further comprising discharging the separated air to atmosphere.

3. The method of claim 1 wherein the step of establishing comprises providing an outer hose extending over, and in a spaced relation to, the first-mentioned hose.

4. The method of claim 1 wherein the compressor has a plurality of porous blades so that the mixture separates on the blades and the vapor passes into the interior of the blades.

5. The method of claim 4 further comprising providing a plurality of collection ports for receiving the separated vapor from the blades and passing the separated gasoline vapor to the gasoline flow through the hose.

6. The method of claim 1 further comprising providing a turbine in the hose for rotation in response to the flow of gasoline through the hose, and coupling the turbine to the compressor to activate same.

7. The method of claim 6 further comprising providing a rotor in the vapor passage so that the rotor rotates in response to the passage of the mixture through the vapor passage.

8. The method of claim 7 wherein the rotor has a plurality of porous blades so that the mixture separates on the blades and the separated vapor passes into the interior of the blades.

9. The method of claim 8 further comprising providing passing the separated vapor into and through a plurality of collection ports, and passing the separated vapor from the collection ports to the gasoline flow through the hose.

10. The method of claim 7 further comprising interacting a stator with the rotor to reduce turbulence and promote laminar flow of the air/vapor mixture along the surface of the rotor blades to promote the separation.

11. A vapor recovery device for a fuel dispensing system, comprising:

a fuel passage in communication with the fuel dispensing system and a destination for delivering fuel from the fuel dispensing system to the destination;

a recovery passage in communication with the destination for recovering vapor from the destination;

a turbine disposed within the fuel passage, wherein flow of fuel through the fuel passage causes the turbine to rotate;

a compressor in the recovery passage, the turbine and the compressor coupled such that rotation of the turbine causes rotation of the compressor, and rotation of the compressor draws vapor from the destination through the recovery passage;

a conduit in the recovery passage having a porous surface adapted to allow passage of vapor from the recovery passage into an interior of the conduit; and a collector passage in communication with the interior of the conduit and the fuel passage to communicate vapor in the interior of the conduit to the fuel passage.

12. The vapor recovery device of claim 11 wherein the compressor has a plurality of blades and the conduit is at least one of the blades of the compressor.

13. The vapor recovery device of claim 11 further comprising a rotor in the recovery passage, the rotor having a plurality of blades and configured such that flow through the recovery passage causes the rotor to rotate, wherein the conduit is at least one of the blades of the rotor.

14. The vapor recovery device of claim 12 further comprising a rotor in the recovery passage, the rotor having a plurality of blades and configured such that flow through the recovery passage causes the rotor to rotate, wherein the conduit is at least one of the blades of the rotor and at least one of the blades of the compressor.

15. The vapor recovery device of claim 11 wherein the fuel passage has a venturi section of reduced diameter in communication with the collector passage, the venturi section configured to draw vapor through the collector passage and into the fuel passage.

16. The vapor recovery device of claim 12 wherein the collector passage is in communication with a tip of the blades and movement of vapor through the conduit is assisted by centrifugal force of the motion of the blades.

17. The vapor recovery device of claim 13 wherein the collector passage is in communication with a tip of the blades and movement of vapor through the conduit is assisted by centrifugal force of the motion of the blades.

18. The vapor recovery device of claim 11 wherein the fuel passage and the recovery passage are substantially coaxial.

19. The vapor recovery device of claim 11 wherein an end of the recovery passage opposite the destination is open to the atmosphere.

20. The vapor recovery device of claim 11 further comprising a stator in the recovery passage configured to reduce turbulence.

* * * * *